US006679065B1

(12) United States Patent
Bessler et al.

(10) Patent No.: US 6,679,065 B1
(45) Date of Patent: Jan. 20, 2004

(54) TEMPERATURE CONTROLLED COMPARTMENT APPARATUS AND METHOD OF CONTROLLING TEMPERATURE

(75) Inventors: Warren Frank Bessler, Amsterdam, NY (US); Martin Mitchell Zentner, Prospect, KY (US); Venkataramana Rachakonda, Andhra Pradesh (IN); Debra Ann Miozza, Louisville, KY (US); Anand Ganesh Joshi, Bangalore (IN); Sanjay Manohar Anikhindi, Bangalore (IN); Venkata Ramakrishna Ramayanam, Louisville, KY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/212,374

(22) Filed: Aug. 5, 2002

(51) Int. Cl.[7] ..... F25B 21/02; F25B 45/00; F25B 41/00

(52) U.S. Cl. ..... 62/3.6; 62/3.7; 62/149; 62/209

(58) Field of Search ..... 62/3.6, 3.7, 149, 62/209, 129, 126, 211, 223, 174, 208

(56) References Cited

U.S. PATENT DOCUMENTS 5,437,503 A 8/1995 Baker et al.
5,505,046 A * 4/1996 Nelson et al. ..... 62/3.6
5,611,211 A 3/1997 Whipple, III
5,813,233 A * 9/1998 Okuda et al. ..... 62/3.7
6,003,319 A * 12/1999 Gilley et al. ..... 62/3.7
6,055,823 A 5/2000 Baker et al.
6,196,011 B1 3/2001 Bessler
6,405,548 B1 6/2002 Hollenbeck
6,412,286 B1 * 7/2002 Park et al. ..... 62/3.6
6,463,743 B1 * 10/2002 Laliberte ..... 62/3.3
6,598,404 B2 * 7/2003 Kruip ..... 62/3.3

* cited by examiner

*Primary Examiner*—William C. Doerrler
*Assistant Examiner*—Filip Zec
(74) *Attorney, Agent, or Firm*—Jean K. Testa; Patrick K. Patnode

(57) ABSTRACT

A temperature controlled apparatus comprises a reversible solid state device having a first section and a second section; portions of the first and the second sections are disposed in intimate contact. The first section is disposed adjacent to a portion of an external wall surface of a compartment and the second section is disposed adjacent to a portion of an internal wall surface of the compartment. A compartment fan is disposed within the compartment. The reversible solid state device and the compartment fan are coupled to a controller. The controller is configured to modify a compartment air temperature inside the compartment by controlling the reversible solid state device and the compartment fan to flow a compartment air across the second section. The controller is configured to control the reversible solid state device and the compartment fan in at least one temperature operational mode.

53 Claims, 6 Drawing Sheets

TEMPERATURE CONTROLLED COMPARTMENT APPARATUS AND METHOD OF CONTROLLING TEMPERATURE

BACKGROUND

This invention relates generally to refrigerators, and more particularly, to a temperature controlled compartment disposed in the refrigerators.

Temperature controlled compartments are typically cooled by, but are not limited to, a simple vapor compression cycle. The simple vapor compression cycle typically includes a compressor, a condenser, an expansion device, and an evaporator connected in series and charged with a refrigerant. The evaporator is a specific type of heat exchanger that transfers heat from air passing over the evaporator to refrigerant flowing through the evaporator, thereby causing the refrigerant to vaporize. The cooled air is then used to refrigerate one or more freezer or fresh food compartments.

Household refrigerators typically operate on a simple vapor compression cycle. Such a cycle typically includes a compressor, a condenser, an expansion device, and an evaporator connected in series and charged with a refrigerant. The evaporator is a specific type of heat exchanger that transfers heat from air passing over the evaporator to refrigerant flowing through the evaporator, thereby causing the refrigerant to vaporize. The cooled air is then used to refrigerate one or more freezer or fresh food compartments.

Household refrigerators are expected to operate over a range of ambient temperatures, typically from about 55° F. to about 90° F. System users are typically supplied control knobs to adjust Fresh Food and Freezer compartment temperatures. At each combined setting of the control knobs, there is a target set of Fresh Food and Freezer temperatures that an ideal refrigerator should achieve, independent of ambient conditions. Different hardware and control strategies attempt to approximate this ideal performance matrix.

Typically, a control device is used to regulate airflow to the fresh food compartment to account for the changing load split between freezer and fresh food sections. During high ambient temperature and frequent fresh food access, more airflow to the fresh food section is required to maintain target temperatures. Manual damper air control cannot automatically compensate for changing loads and is prone to customer misadjustment. Motorized damper airflow modulation, powered by a system controller, is prone to malfunction (i.e. freeze up) and may cause adverse temperature gradients during low ambient operation.

Accordingly, there is a need in the art for an improved refrigeration system for achieving ideal performance temperatures of temperature controlled compartments.

BRIEF SUMMARY

A temperature controlled apparatus comprises a reversible solid state device having a first section and a second section; portions of the first and the second sections are disposed in intimate contact. The first section is disposed adjacent to a portion of an external wall surface of a compartment and the second section is disposed adjacent to a portion of an internal wall surface of the compartment. A compartment fan is disposed within the compartment. The reversible solid state device and the compartment fan are coupled to a controller. The controller is configured to modify a compartment air temperature inside the compartment by controlling the reversible solid state device and the compartment fan to flow a compartment air across the second section. The controller is configured to control the reversible solid state device and the compartment fan in at least one temperature operational mode.

DRAWINGS

These and other features, aspects, and advantages of the present invention will become better understood when the following detailed description is read with reference to the accompanying drawings in which like characters represent like parts throughout the drawings, wherein.

DESCRIPTION

Figure 1:
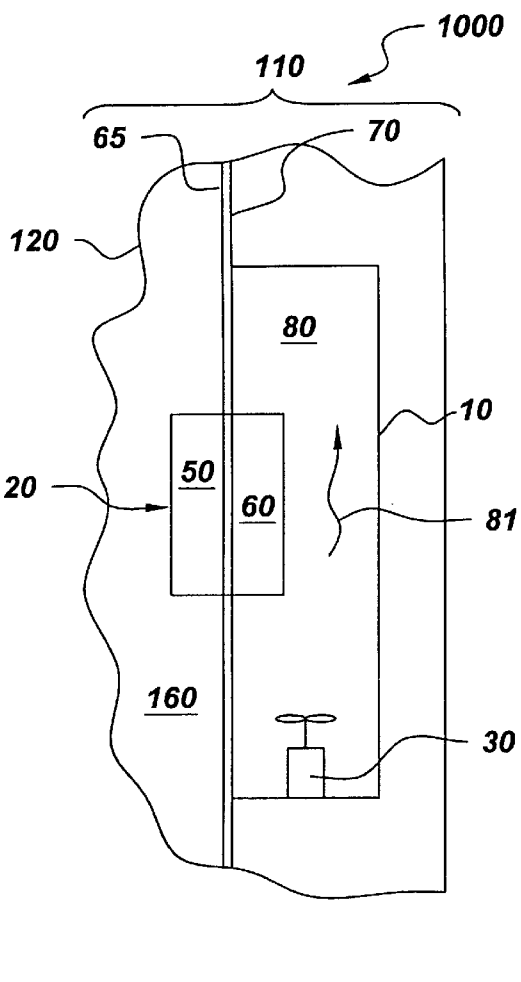
FIG. 1 is a cross sectional view of the temperature controlled compartment in accordance with one embodiment of the present invention.
Figure 11:
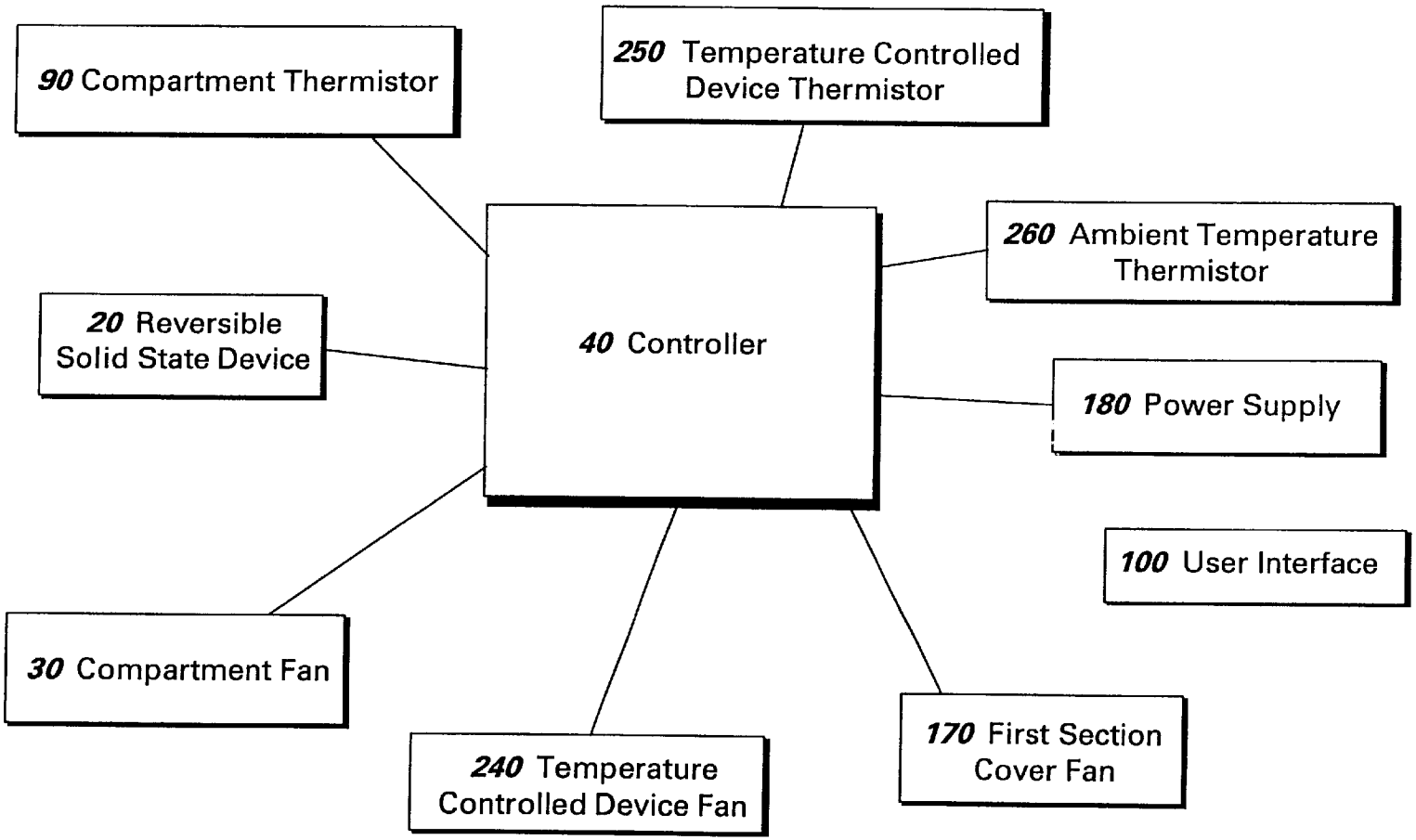
FIG. 11 is a block diagram of the inputs and outputs to a controller in accordance with another embodiment of the present invention.

FIG. 1 provides a partial cut-away cross sectional view of a temperature controlled apparatus 1000 comprising a compartment 10, a reversible solid state device 20, a compartment fan 30, and a controller 40. The reversible solid state device 20 has a first section 50 and a second section 60, and a portion of the first section 50 and a portion of the second section 60 are disposed in intimate contact. The first section 50 is disposed adjacent to a portion of an external wall surface 65 of the compartment 10 and the second section 60 is disposed adjacent to a portion of an internal wall surface 70 of the compartment 10. The compartment fan 30 is disposed within the compartment 10. The reversible solid state device 20 and the compartment fan 30 are coupled to the controller 40 as shown in FIG. 11. The controller 40 is configured to modify a compartment air temperature inside the compartment 10 of FIG. 1 by controlling the reversible solid state device 20 and the compartment fan 30 to flow a compartment air 80 across the second section 60. The controller 40 of FIG. 11 is configured to control the reversible solid state device 20 of FIG. 1 and the compartment fan 30 in at least one temperature operational mode.

As used herein, the term "at least one temperature operational mode" relates to at least one of a cooling mode, a heating mode, and combinations thereof.

As used herein, the terms "disposed on", "disposed from", "disposed to", "disposed over", "disposed above" and the like are used to refer to relative locations of items illustrated in the drawings and do not imply structural or operational limitations in the assembled device.

In one embodiment of the present invention, the compartment fan 30 of FIG. 1 is selected from the group consisting of discreet speed controllable fans, continuous speed fans, variable speed fans, and combinations thereof.

In one embodiment of the present invention, the temperature controlled apparatus 1000 of FIG. 1 is disposed in a temperature controlled device 110. The temperature controlled device 110 is selected from the group consisting of an internal freezer compartment, a door mounted freezer compartment, an internal refrigerator compartment, a door mounted refrigerated compartment land combinations thereof.

In one embodiment of the present invention, the temperature controlled device 110 of FIG. 1 further comprises a main temperature controlled portion 120. The first section 50 of the reversible solid state device 20 is disposed to contact a temperature controlled air 160 that is disposed in the main temperature controlled portion 120.

Figure 2:
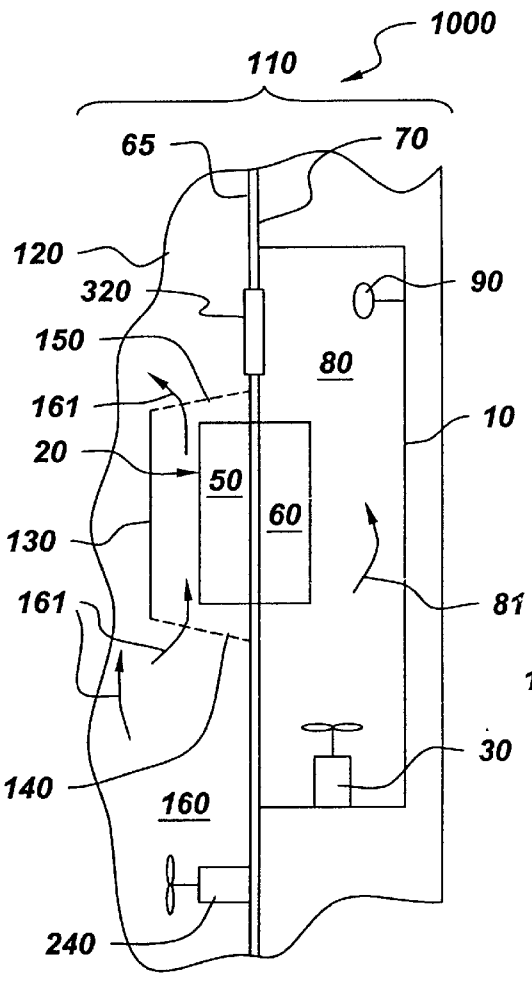
FIG. 2 is a cross sectional view of the temperature controlled compartment with a first section cover in accordance with another embodiment of the present invention.

In one embodiment of the present invention, the temperature controlled apparatus 1000 of FIG. 2 further comprises a compartment thermistor 90 disposed in the compartment 10 to contact the compartment air 80. The compartment thermistor 90 is coupled to the controller 40 of FIG. 11. In one embodiment of the present invention, the controller 40 is configured to control the compartment air temperature using data acquired from the compartment thermistor 90.

In one embodiment of the present invention, the temperature controlled device 110 of FIG. 2 further comprises a temperature control device fan 240 that is disposed in the main temperature control portion 120. The temperature control device fan 240 is coupled to the controller 40 of FIG. 11. The temperature control device fan 240 is disposed to draw the temperature controlled air 160 of FIG. 2 across the first section 50 of the reversible solid state device 20.

In a specific embodiment of the present invention, the temperature control device fan 240 of FIG. 2 is selected from the group consisting of discreet speed controllable fans, continuous speed fans, variable speed fans, and combinations thereof.

In one embodiment of the present invention, the temperature controlled device 110 of FIG. 2 further comprises a first section cover 130 having a first section cover inlet 140 and a first section cover outlet 150. The first section cover 130 is disposed over the first section 50 of the reversible solid state device 20. The first section cover inlet 140 is disposed to draw in the temperature controlled air 160 from the main temperature controlled portion 120. The first section cover outlet 150 is disposed to exhaust the temperature controlled air 160 to the main temperature controlled portion 120 after the temperature controlled air 160 passes over the first section 50 of the reversible solid state device 20.

In one embodiment of the present invention, the temperature control device fan 240 of FIG. 2 is disposed to draw a portion of the temperature controlled air 160 through the first section cover inlet 140, across the first section 50 of the reversible solid state device 20 and exhaust the temperature controlled air 160 through the first section cover exhaust 150. The temperature control device fan 240 is also disposed to direct another portion of the temperature controlled air 160 over the temperature controlled device thermistor 250.

In one embodiment of the present invention, the temperature controlled apparatus 1000 further comprises a compartment door 320 of FIG. 2 that is disposed to provide a user access to the compartment 10.

Figure 3:
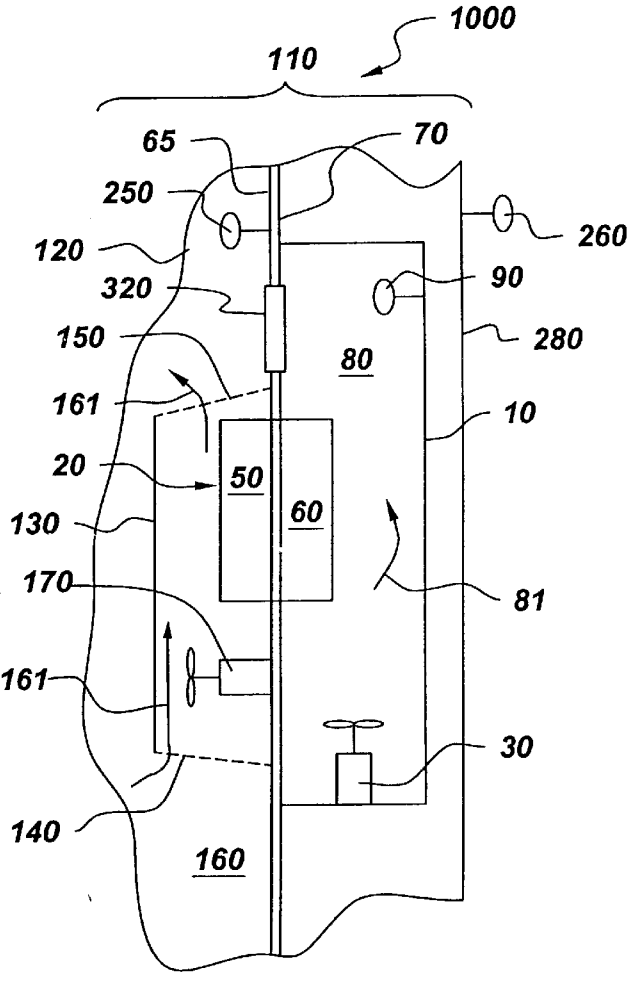
FIG. 3 is a cross sectional view of the temperature controlled compartment with a first section cover and a first section cover fan in accordance with another embodiment of the present invention.

In one embodiment of the present invention, the temperature controlled apparatus 1000 of FIG. 3 further comprises a temperature control device thermistor 250 disposed in the temperature control device 110. The temperature control device thermistor 250 is disposed to contact a temperature controlled air 160. The temperature control device thermistor 250 is spaced apart from the compartment 10. The temperature control device thermistor 250 is coupled to the controller 40 of FIG. 11. The controller 40 is configured to control the compartment air temperature using data acquired from the temperature control device thermistor 250.

In one embodiment of the present invention, the temperature controlled apparatus 1000 of FIG. 3 further comprises an ambient air thermistor 260. The ambient air thermistor 260 is disposed on a portion of an external wall 280 of the temperature control device 110. The ambient air thermistor 260 is disposed to be spaced apart from the compartment 10. The ambient air thermistor 260 is coupled to the controller 40 of FIG. 11. The controller 40 is configured to control the compartment air temperature using data acquired from the ambient air thermistor 260.

In one embodiment of the present invention, the temperature controlled apparatus 1000 of FIG. 3 further comprises a first section cover fan 170 disposed between the first section cover 130 and the external wall surface 65 of the compartment 10. The first section cover fan 170 is coupled to the controller 40 of FIG. 11. The first section cover fan 170 is disposed to draw the temperature controlled air 160 of FIG. 3 through the first section cover inlet 140, across the first section 50 of the reversible solid state device 20, and exhaust the temperature controlled air 160 through the first section cover exhaust 150.

In one embodiment of the present invention, the first section cover fan 170 of FIG. 3 is selected from the group consisting of discreet speed controllable fans, continuous speed fans, variable speed fans, and combinations thereof.

Figure 4:
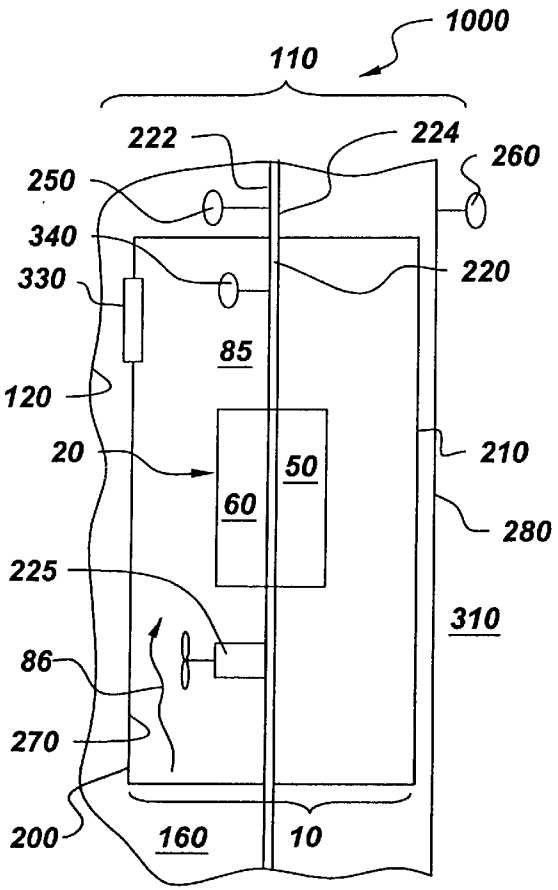
FIG. 4 is a cross sectional view of the temperature controlled compartment with an internal compartment and an external compartment in accordance with another embodiment of the present invention.

In another embodiment of the present invention, the compartment 10 of FIG. 4 of the temperature controlled apparatus 1000 comprises an internal compartment 200 and an external compartment 210. The temperature controlled apparatus 1000 further comprises the reversible solid state device 20, an internal compartment fan 225, and the controller 40 of FIG. 12. The internal compartment 200 of FIG. 4 and the external compartment 210 are disposed to share a portion of a common wall 220. The internal compartment 200 comprises an internal wall 270 that is disposed to a portion of the main temperature controlled portion 120 of the temperature controlled device 110.

The external compartment 210 is spaced apart from the main temperature controlled portion 120 of the temperature controlled device 110. The reversible solid state device 20 has the first section 50 and the second section 60. A portion of the first section 50 and a portion of the second section 60 are disposed in intimate contact. The first section 50 of the reversible solid state device 20 is disposed in the external compartment 210 adjacent to a portion of a common wall external surface 224 on the common wall 220. The second section 60 of the reversible solid state device 20 is disposed in the internal compartment 200 adjacent to a portion of a common wall internal surface 222 on the common wall 220.

The internal compartment fan 225 is disposed in the internal compartment 200. An internal compartment airflow direction 86 is depicted in FIG. 4. The reversible solid state device 20 and the internal compartment fan 225 are coupled to the controller 40 of FIG. 12. The controller 40 is configured to modify an internal compartment air temperature inside the internal compartment 200 of FIG. 4 by controlling the reversible solid state device 20 and the internal compartment fan 225 to flow an internal compartment air 85 across the second section 60. The controller 40 is configured to control the reversible solid state device 20 and the internal compartment fan 225 in at least one temperature operational mode.

In one specific embodiment of the present invention, the heat given off by the first section 50 to the external compartment 210 is then transmitted to the external wall 280 by conduction as shown in FIG. 4. In another specific embodiment of the present invention not shown in FIG. 4, the first section 50 is disposed in direct contact to the external wall 280.

In another embodiment of the present invention, the temperature controlled apparatus 1000 of FIG. 4 further comprises the temperature control device thermistor 250 disposed in the main temperature controlled portion 120 of the temperature control device 110 to contact the temperature controlled air 160. The temperature control device thermistor 250 is spaced apart from the internal compartment 200 and the external compartment 210 and the temperature control device thermistor 250 is coupled to the controller 40 of FIG. 12. The controller 40 is configured to control the internal compartment air temperature using data acquired from the temperature control device thermistor 250.

In another embodiment of the present invention, the temperature controlled apparatus 1000 further comprises an internal compartment thermistor 340 of FIG. 4 disposed in the internal compartment 200 to contact the internal compartment air 85. The internal compartment thermistor 340 is coupled to the controller 40 of FIG. 12. The controller 40 is configured to control the internal compartment air temperature using data acquired from the internal compartment thermistor 340.

In another embodiment of the present invention, the temperature controlled apparatus 1000 further comprises an internal compartment door 330 of FIG. 4 that is disposed to provide a user access to the internal compartment 200.

Figure 5:
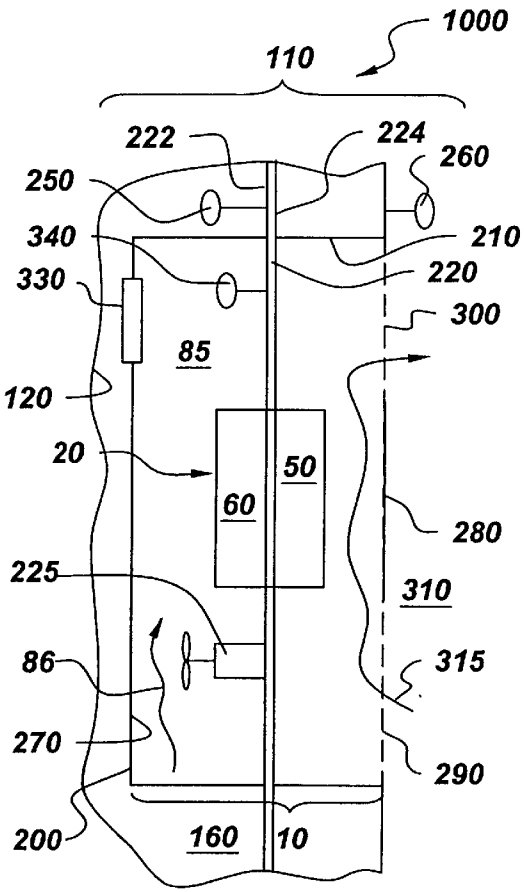
FIG. 5 is a cross sectional view of the temperature controlled compartment with an internal compartment, an external compartment, and an external airflow path in accordance with another embodiment of the present invention.

In another embodiment of the present invention, the external compartment 210 of FIG. 5 of the temperature controlled apparatus 1000 comprises the external wall 280. The external wall 280 comprises an external wall inlet 290 and an external wall outlet 300. The external wall inlet 290 is disposed to draw in an external air 310 from outside the external compartment 210. The external wall outlet 300 is disposed to exhaust the external air 310 to outside of the external compartment 210 after passing the external air 310 over the first section 50 of the reversible solid state device 20. The external airflow direction 315 in one embodiment of the present invention is depicted in FIG. 5.

In one specific embodiment of the present invention, the internal compartment fan 225 of FIG. 5 is selected from the group consisting of discreet speed controllable fans, continuous speed fans, variable speed fans, and combinations thereof.

Figure 6:
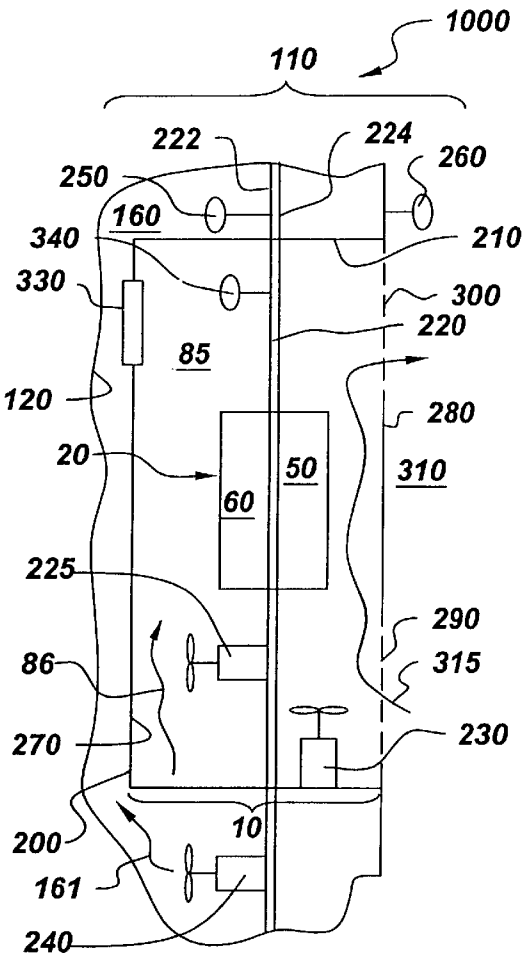
FIG. 6 is a cross sectional view of the temperature controlled compartment with an internal compartment, an external compartment, an external airflow path, and an external compartment fan in accordance with another embodiment of the present invention.

In a specific embodiment of the present invention, the external compartment 210 of FIG. 6 of the temperature controlled apparatus 1000 further comprises an external compartment fan 230. The external compartment fan 230 is coupled to the controller 40 of FIG. 12. The external compartment fan 230 is disposed to draw the external air 310 through the external wall inlet 290, across the first section 50 of the reversible solid state device 20 and exhaust the external air 310 through the external wall outlet 300. The external airflow direction is depicted as 315.

In another embodiment of the present invention, the external compartment fan 230 of FIG. 6 is selected from the group consisting of discreet speed controllable fans, continuous speed fans, variable speed fans, and combinations thereof.

Figure 12:
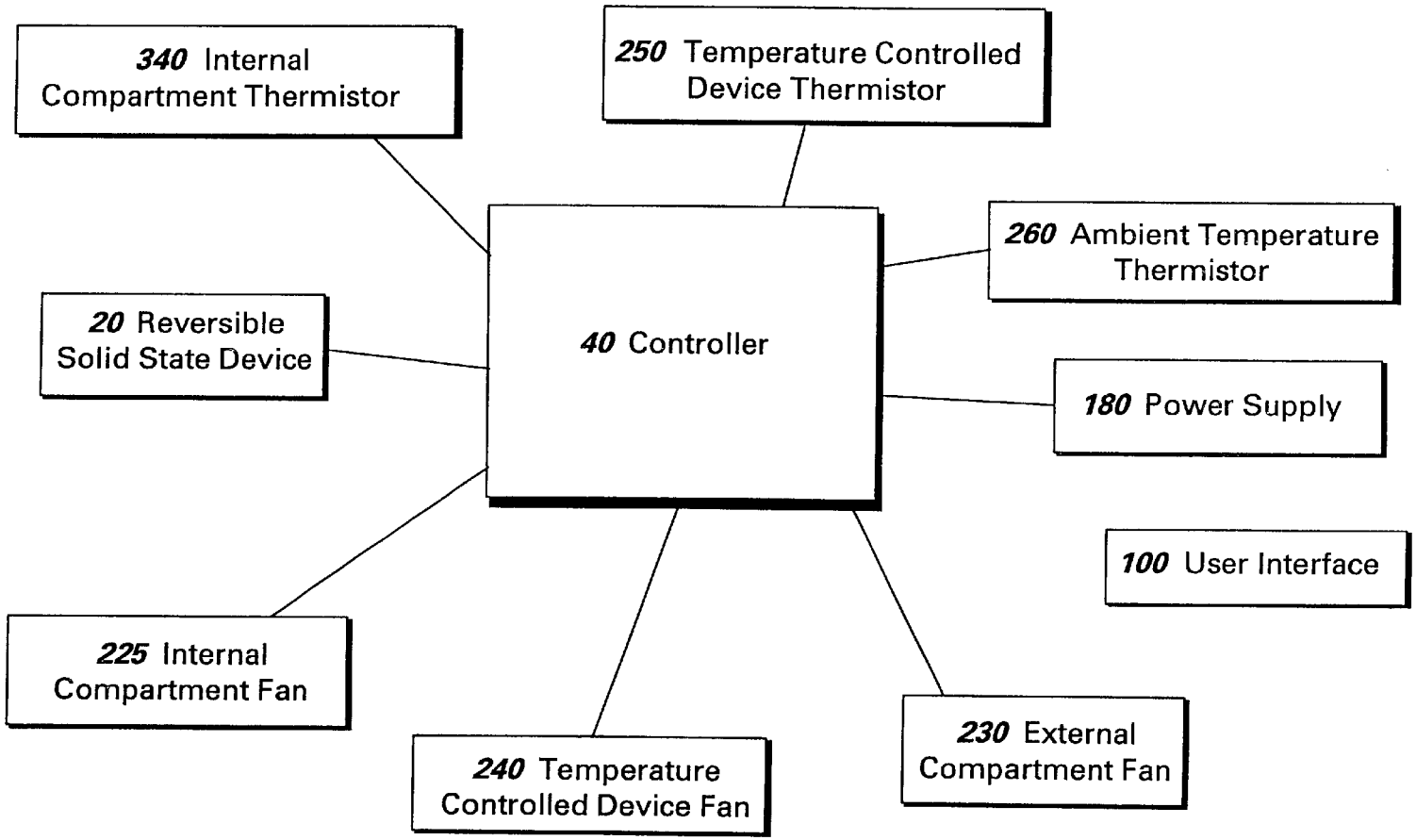
FIG. 12 is a block diagram of the inputs and outputs to a controller in accordance with another embodiment of the present invention.

In another embodiment of the present invention, the temperature controlled apparatus 1000 of FIG. 6 further comprises the temperature control device fan 240 coupled to the controller 40 of FIG. 12. The temperature control device fan 240 is disposed on the common wall internal surface 222 and is spaced apart from the internal compartment 200. The temperature control device fan 240 is configured to blow the temperature controlled air 160 over a surface of the internal compartment 200.

In another embodiment of the present invention, the temperature controlled apparatus 1000 of FIG. 6 further comprises the ambient air thermistor 260 coupled to the controller 40 of FIG. 12. The ambient air thermistor 260 is disposed on the common wall internal wall surface 222 of FIG. 6. The ambient air thermistor 260 operates as discussed above with respect to FIG. 3.

Figure 8:
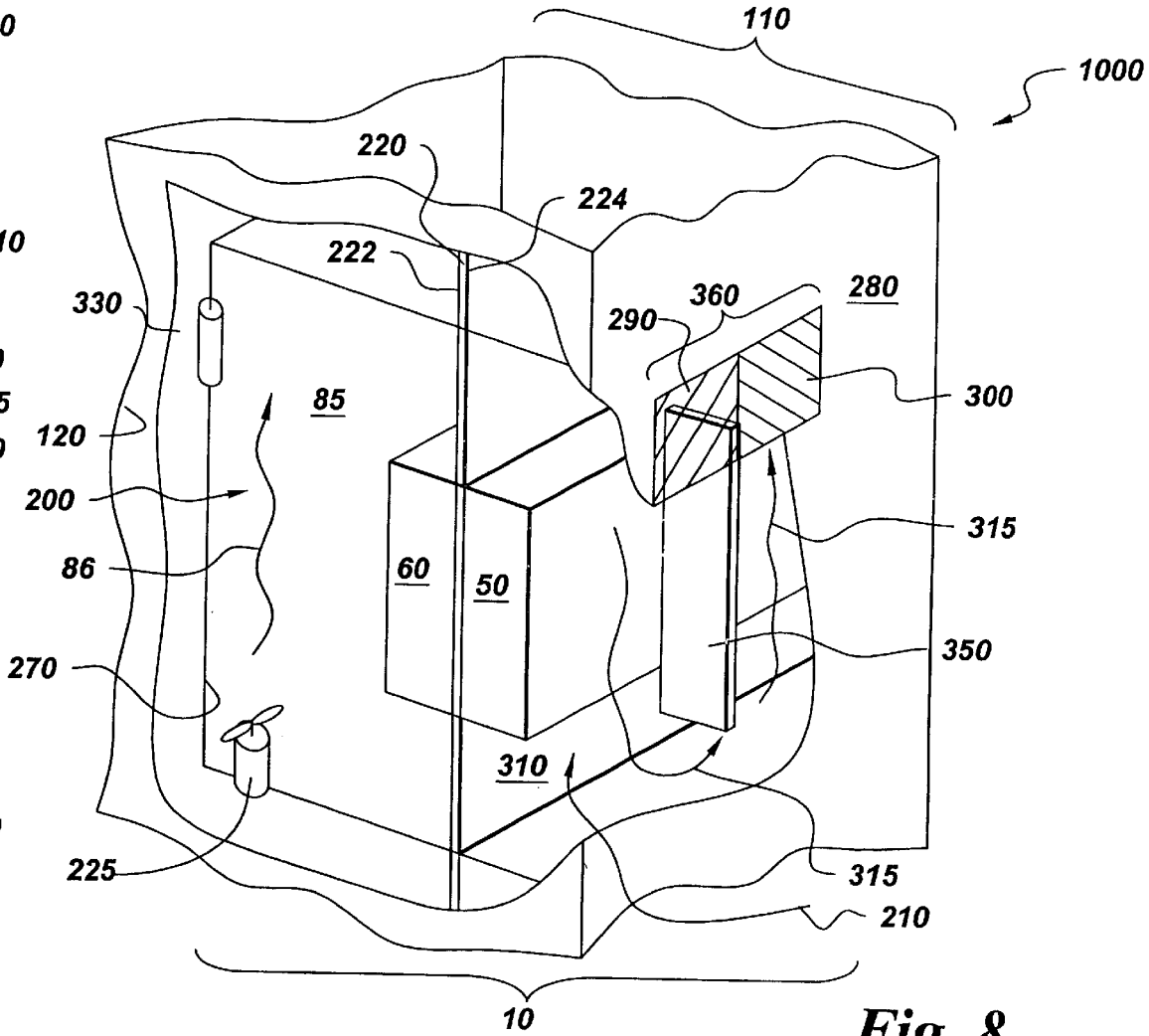
FIG. 8 is a partial three dimensional cross sectional view of the temperature controlled compartment with an internal compartment, an external compartment, an external wall ventilation duct, an external airflow path, and an internal compartment fan in accordance with another embodiment of the present invention.
Figure 7:
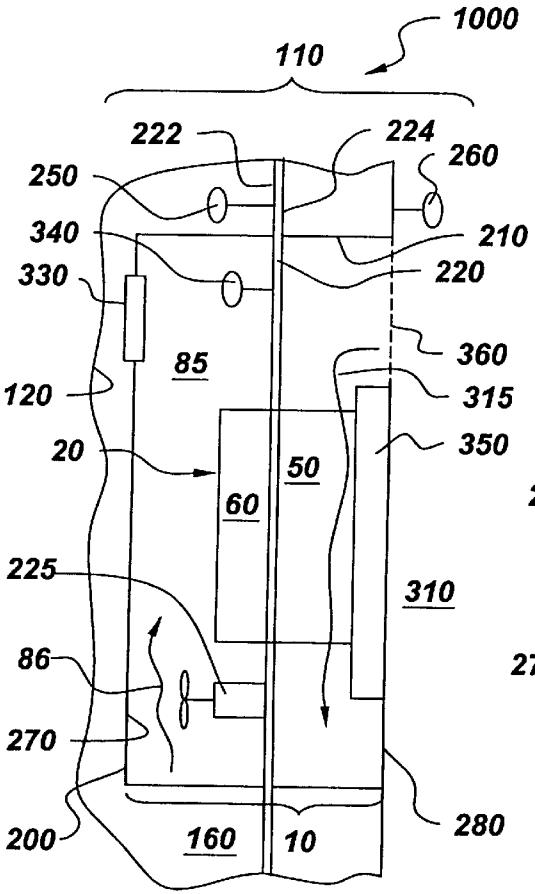
FIG. 7 is a cross sectional view of the temperature controlled compartment with an internal compartment, an external compartment, a combined external wall duct, an external airflow path, and an internal compartment fan in accordance with another embodiment of the present invention.

In another embodiment of the present invention, the temperature controlled apparatus 1000 as shown in FIGS. 7 and 8 comprises an external airflow divider 350 and an external wall ventilation duct 360. The external Wall inlet 290 and the external wall outlet 300 are disposed in the external wall ventilation duct 360. The external airflow divider 350 is disposed between the first section 50 and the external wall 280. The external wall ventilation duct 360 and the external airflow divider 350 are disposed so as to draw the external air 310 down past a portion of the first section 50, around one end of the external airflow divider 350, and up past another portion of the second section 60. The external airflow direction is depicted as 315.

Figure 10:
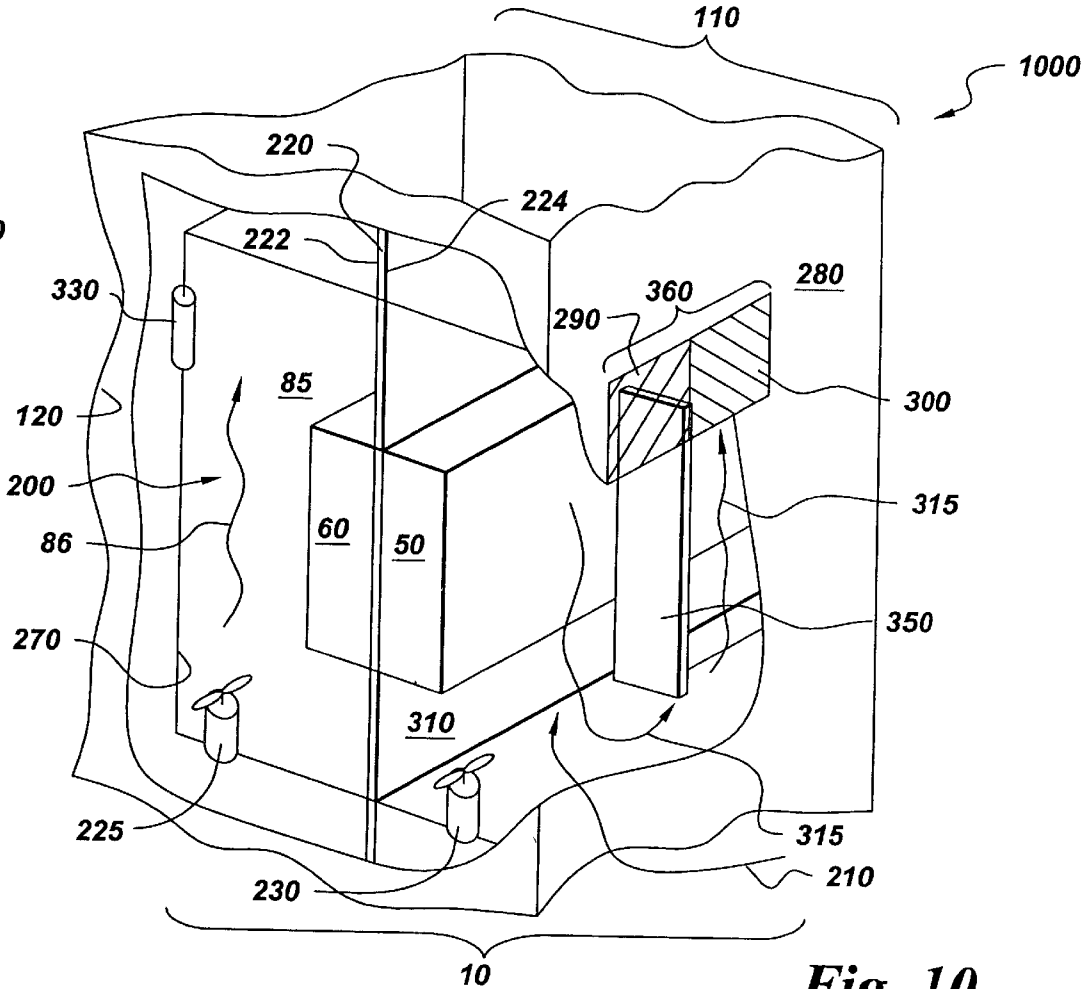
FIG. 10 is a partial three dimensional cross sectional view of the temperature controlled compartment with an internal compartment, an external compartment, an external wall ventilation duct, an external airflow path, an external compartment fan, and an internal compartment fan in accordance with another embodiment of the present invention.
Figure 9:
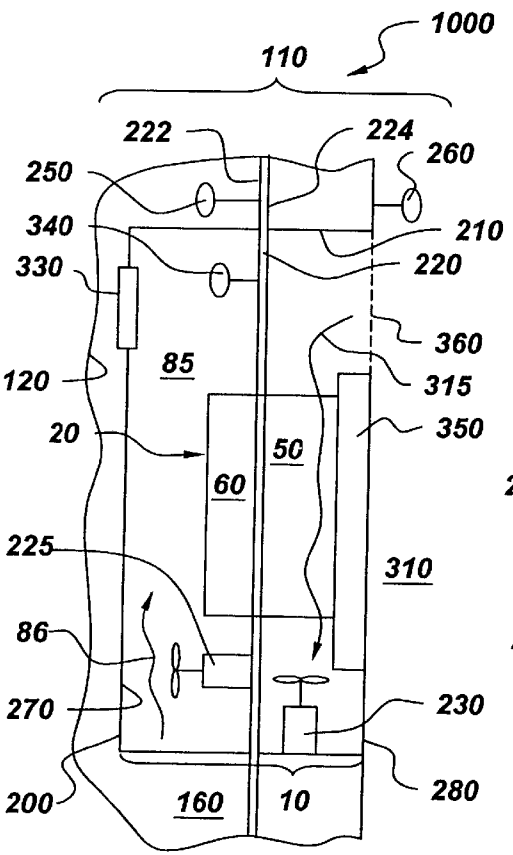
FIG. 9 is a cross sectional view of the temperature controlled compartment with an internal compartment, an external compartment, a combined external wall duct, an external airflow path, an external compartment fan, and an internal compartment fan in accordance with another embodiment of the present invention.

In another embodiment of the present invention, the temperature controlled apparatus 1000 as shown in FIGS. 9 and 10 comprises an embodiment of the present invention as discussed above in FIGS. 7 and 8 with the addition of the external compartment fan 230. The external wall inlet 290 and the external wall outlet 300 are disposed in the external wall ventilation duct 360 as discussed above with respect to FIGS. 7 and 8. The external airflow divider 350 is disposed between the first section 50 and the external wall 280. The external wall ventilation duct 360, the external airflow divider 350, and the external compartment fan 230 are disposed so as to draw the external air 310 down past a portion of the first section 50, around one end of the external airflow divider 350, and up past another portion of the first section 50.

In one embodiment of the present invention, the controller 40 of FIG. 11 is configured to change an electrical polarity of an electrical power supply 180 to the reversible solid state device 20 to switch from the cooling,mode to the heating mode. In another embodiment of the present invention, the controller 40 is configured to change an electrical polarity of the electrical power supply 180 to the reversible solid state device 20 to switch from the heating mode to the cooling mode.

In one embodiment of the present invention, the controller 40 of FIGS. 11 and 12 is configured to vary the voltage supplied to the reversible solid state device 20.

In a specific embodiment of the present invention, the controller 40 of FIG. 11 is configured to maintain a constant voltage to the reversible solid state device 20 and modulate a speed of the compartment fan 30.

In one embodiment of the present invention, the controller 40 of FIG. 11 is configured to hold the compartment air temperature in a range from about 40 degrees F. to about 50 degrees F. when operating in the heating mode. In another embodiment of the present invention, the controller 40 is configured to hold the compartment air temperature in a range from about 20 degrees F. to about 30 degrees F. when operating in the cooling mode.

In one embodiment of the present invention, the temperature controlled apparatus 1000 further comprises a user interface 100 of FIGS. 11 and 12 coupled to the controller 40 of FIGS. 11 and 12, respectively . The user interface 100 is configured to allow a user to select at least one operational mode. The operational modes are the same as discussed above with regards to FIG. 1.

In a specific embodiment of the present invention, the controller 40 of FIG. 12 is configured to maintain a constant voltage to the reversible solid state device 20 and modulate a speed of the internal compartment fan 225.

A method for temperature control is provided in one embodiment of the present invention that comprises 1) modifying a compartment air temperature inside a compartment 10 by controlling a reversible solid state device 20 and a compartment fan 30, 2) flowing a compartment air 80 across a second section 60 of reversible solid state device 20 where the second section 60 is disposed within the compartment 10, 3) flowing a temperature controlled air 160 across a first section 50 of the reversible solid state device 20, where a portion of first section 50 is disposed outside the compartment 10, and 4) controlling the compartment air temperature in at least one temperature operational mode.

In one embodiment of the present invention, the method further comprises changing an electrical polarity of an electrical power supply 180 to the reversible solid state device 20 to switch from the cooling mode to the heating mode. In another embodiment of the present invention, the method further comprises changing the electrical polarity of the electrical power supply 180 to the reversible solid state device 20 to switch from the heating mode to the cooling mode.

In one embodiment of the present invention, the method further comprises holding the compartment air temperature in a range from about 40 degrees F. to about 50 degrees F. when operating in the heating mode.

In one embodiment of the present invention, the method further comprises holding the compartment air temperature in a range from about 20 degrees F. to about 30 degrees F. when operating in the cooling mode.

Another method for temperature control is provided in another embodiment of the present invention that comprises 1) modifying the interior compartment air temperature inside the interior compartment 200 by controlling the reversible solid state device 20 and the internal compartment fan 225, 2) flowing the interior compartment air 85 across the second section 60 of the reversible solid state device 20, where the second section 60 is disposed within the interior compartment 200, 3) flowing the external air 310 across the first section 50 of the reversible solid state device 20, where the first section 50 is disposed in the exterior compartment 210, and 4) controlling the interior compartment air temperature in at least one temperature operational mode.

The foregoing description of several embodiments of the present invention has been presented for purposes of illustration. Although the invention has been described and illustrated in detail, it is to be clearly understood that the same is intended by way of illustration and example only and is not to be taken by way of limitation. Obviously many modifications and variations of the present invention are possible in light of the above teaching. Accordingly, the spirit and scope of the present invention are to be limited only by the terms of the appended claims.

What is claimed is:

1. A temperature controlled apparatus comprising:

a compartment;

a reversible solid state device;

a compartment fan; and a controller;

said reversible solid state device having a first section and a second section, a portion of said first section and a portion of said second section being disposed in intimate contact, said first section being disposed adjacent to a portion of an external wall surface of said compartment and said second section being disposed adjacent to a portion of an internal wall surface of said compartment, said compartment fan being disposed within said compartment, said reversible solid state device and said compartment fan being coupled to said controller, said controller being configured to modify a compartment air temperature inside said compartment by controlling said reversible solid state device and said compartment fan so as to flow a compartment air across said second section, said controller being configured to control said reversible solid state device and said compartment fan in at least one temperature operational mode, wherein said temperature operational mode is selected from the group consisting of a cooling mode, a heating mode and combinations thereof.

2. The apparatus of claim 1, wherein said at least one temperature operational mode is selected from the group consisting of a cooling mode, a heating mode, and combinations thereof;

wherein said controller is configured to change an electrical polarity of an electrical power supply to said reversible solid state device to switch from said cooling mode to said heating mode.

3. The apparatus of claim 1, wherein said at least one temperature operational mode is selected from the group consisting of a cooling mode, a heating mode, and combinations thereof;

wherein said controller is configured to change an electrical polarity of an electrical power supply to said reversible solid state device to switch from said heating mode to said cooling mode.

4. The apparatus of claim 1, wherein said controller is configured to vary the voltage supplied to said reversible solid state device.

5. The apparatus of claim 1, wherein said controller is configured to maintain a constant voltage to said reversible solid state device and modulate a speed of said compartment fan.

6. The apparatus of claim 1, wherein said compartment fan is selected from the group consisting of discreet speed controlable fans, continuous speed fans, variable speed fans, and combinations thereof.

7. The apparatus of claim 1, further comprising a compartment thermistor disposed in said compartment so as to contact said compartment air;

wherein said compartment thermistor is coupled to said controller;

wherein said controller is configured to control said compartment air temperature using data acquired from said compartment thermistor.

8. The apparatus of claim 1, wherein said at least one temperature operational mode is selected from the group consisting of a cooling mode, a heating mode, and combinations thereof;

wherein said controller is configured to hold said compartment air temperature in a range from about 40 degrees F. to about 50 degrees F. when operating in said heating mode.

9. The apparatus of claim 1, wherein said at least one temperature operational mode is selected from the group consisting of a cooling mode, a heating mode, and combinations thereof;

wherein said controller is configured to hold said compartment air temperature in a range from about 20 degrees F. to about 30 degrees F. when operating in said cooling mode.

10. The apparatus of claim 1 further comprising a user interface coupled to said controller;

wherein said user interface is configured to allow a user to select at least one operational mode;

wherein said at least one temperature operational mode is selected from the group consisting of a cooling mode, a heating mode, and combinations thereof.

11. The apparatus of claim 1, wherein said apparatus is disposed in a temperature controlled device, wherein said temperature controlled device is selected from the group consisting of an internal freezer compartment, a door mounted freezer compartment, an internal refrigerator compartment, a door mounted refrigerated compartment, and combinations thereof.

12. The apparatus of claim 11, further comprising a temperature control device thermistor disposed in said temperature control device so as to contact a temperature controlled air;

wherein said temperature control device thermistor is spaced apart from said compartment;

wherein said temperature control device thermistor is coupled to said controller;

wherein said controller is configured to control said compartment air temperature using data acquired from said temperature control device thermistor.

13. The apparatus of claim 11, further comprising an ambient air thermistor;

wherein said ambient air thermistor is disposed on a portion of an external wall of said temperature control device;

wherein said ambient air thermistor is disposed to be spaced apart from said compartment;

wherein said ambient air thermistor is coupled to said controller;

wherein said controller is configured to control said compartment air temperature using data acquired from said ambient air thermistor.

14. The apparatus of claim 11, wherein said temperature controlled device further comprises a main temperature controlled portion;

wherein said first section of said reversible solid state device is disposed to contact a temperature controlled air that is disposed in said main temperature controlled portion.

15. The apparatus of claim 14, further comprising a temperature control device fan disposed in said main temperature control portion;

wherein said temperature control device fan is coupled to said controller;

wherein said temperature control device fan is disposed to draw said temperature controlled air across said first section of said reversible solid state device.

16. The apparatus of claim 15, wherein said temperature control device fan is selected from the group consisting of discreet speed controlable fans, continuous speed fans, variable speed fans, and combinations thereof;

wherein said controller is configured to maintain a constant voltage to said reversible solid state device and modulate a speed of said temperature control device fan.

17. The apparatus of claim 15 further comprises a first section cover having an first section cover inlet and a first section cover outlet;

wherein said first section cover is disposed over said first section of said reversible solid state device;

wherein said first section cover inlet is disposed to draw in said temperature controlled air from said main temperature controlled portion;

wherein said first section cover outlet is disposed to exhaust said temperature controlled air to said main temperature controlled portion after said temperature controlled air passes over said first section of said reversible solid state device.

18. The apparatus of claim 17 further comprises a first section cover fan disposed between said first section cover and said external wall surface of said compartment;

wherein said first section cover fan is coupled to said controller;

wherein said first section cover fan is disposed to draw said temperature controlled air through said first section cover inlet, across said first section of said reversible solid state device, and exhaust said temperature controlled air through said first section cover exhaust.

19. The apparatus of claim 18, wherein said first section cover fan is selected from the group consisting of discreet speed controlable fans, continuous speed fans, variable speed fans, and combinations thereof;

wherein said controller is configured to maintain a constant voltage to said reversible solid state device and modulate a speed of said first section cover fan.

20. The apparatus of claim 18, wherein said temperature control device fan is disposed to draw a portion of said temperature controlled air through said first section cover inlet, across said first section of said reversible solid state device and exhaust said temperature controlled air through said first section cover exhaust;

wherein said said temperature control device fan is disposed to direct another portion of said temperature controlled air over said temperature controlled device thermistor.

21. The apparatus of claim 1, further comprising a compartment door being disposed to provide a user access to said compartment.

22. A temperature controlled apparatus comprising:

a compartment comprising an internal compartment and an external compartment;

a reversible solid state device;

an internal compartment fan; and a controller;

said internal compartment and said external compartment being disposed to share a portion of a common wall, said internal compartment comprising an internal wall being disposed to a portion of a main temperature controlled portion of a temperature controlled device, said external compartment being spaced apart from said main temperature controlled portion of said temperature controlled device, said reversible solid state device having a first section and a second section, a portion of said first section and a portion of said second section being disposed in intimate contact, said first section of said reversible solid state device being disposed in said external compartment adjacent to a portion of a common wall external surface on said common wall, said second section of said reversible solid state device being disposed in said internal compartment adjacent to a portion of a common wall internal surface on said common wall, said internal compartment fan being disposed in said internal compartment, said reversible solid state device and said internal compartment fan being coupled to said controller, said controller being configured to modify an internal compartment air temperature inside said internal compartment by controlling said reversible solid state device and said internal compartment fan so as to flow an internal compartment air across said second section, said controller being configured to control said reversible solid state device and said internal compartment fan in at least one temperature operational mode.

23. The apparatus of claim 22, wherein said external compartment comprises an external wall;

wherein said external wall comprises an external wall inlet and an external wall outlet;

wherein said external wall inlet is disposed to draw in an external air from outside said external compartment;

wherein said external wall outlet is disposed to exhaust said external air to outside of said external compartment after passing said external air over said first section of said reversible solid state device.

24. The apparatus of claim 23 further comprising an external wall ventillation duct and an external air flow divider, wherein said external wall inlet and said external wall outlet are disposed in said external wall ventillation duct;

wherein said external air flow divider is disposed between said first section and said external wall;

wherein said said external wall ventillation duct and said external air flow divider are disposed so as to draw said external air down past a portion of said first section, around one end of said external airflow divider, and up past another portion of said second section.

25. The apparatus of claim 23 further comprising an external compartment fan;

wherein said external compartment fan is coupled to said controller, wherein said external compartment fan is disposed to draw said external air through said external wall inlet across said first section of said reversible solid state device and exhaust said external air through said external wall outlet.

26. The apparatus of claim 25 further comprising an external wall ventillation duct and an external airflow divider, wherein said external wall inlet and said external wall outlet are disposed in said external wall ventillation duct;

wherein said external airflow divider is disposed between said first section and said external wall;

wherein said said external wall ventillation duct, said external airflow divider, and said external compartment fan are disposed so as to draw said external air down past a portion of said first section, around one end of said external airflow divider, and up past another portion of said first section.

27. The apparatus of claim 25, wherein said external compartment fan is selected from the group consisting of discreet speed controlable fans, continuous speed fans, variable speed fans, and combinations thereof;

wherein said controller is configured to maintain a constant voltage to said reversible solid state device and modulate a speed of said external compartment fan.

28. The apparatus of claim 22, further comprising a temperature control device thermistor disposed in a main temperature controlled portion of said temperature control device so as to contact a temperature controlled air;

wherein said temperature control device thermistor is spaced apart from said internal compartment and said external compartment;

wherein said temperature control device thermistor is coupled to said controller;

wherein said controller is configured to control said internal compartment air temperature using data acquired from said temperature control device thermistor.

29. The apparatus of claim 28, further comprising a temperature control device fan;

wherein said temperature control device fan is disposed in said main temperature controlled portion;

wherein said temperature control device fan is coupled to said controller;

wherein said temperature control device fan is disposed to direct said temperature controlled air across said temperature controlled device thermistor.

30. The apparatus of claim 29, wherein said temperature control device fan is selected from the group consisting of discreet speed controlable fans, continuous speed fans, variable speed fans, and combinations thereof;

wherein said controller is configured to maintain a constant voltage to said reversible solid state device and modulate a speed of said temperature control device fan.

31. The apparatus of claim 22, further comprising an ambient air thermistor disposed on a portion of an external wall of said temperature control device;

wherein said ambient air thermistor is spaced apart from said internal compartment and said external compartment;

wherein said ambient air thermistor is coupled to said controller;

wherein said controller is configured to control said internal compartment air temperature using data acquired from said ambient air thermistor.

32. The apparatus of claim 22, wherein said at least one temperature operational mode is selected from the group consisting of a cooling mode, a heating mode, and combinations thereof;

wherein said controller is configured to change an electrical polarity of an electrical power supply to said reversible solid:state device to switch from said cooling mode to said heating mode.

33. The apparatus of claim 22, wherein said at least one temperature operational mode is selected from the group consisting of a cooling mode, a heating mode, and combinations thereof;

wherein said controller is configured to change an electrical polarity of an electrical power supply to said reversible solid state device to switch from said heating mode to said cooling mode.

34. The apparatus of claim 22, wherein said controller is configured to vary the voltage supplied to said reversible solid state device.

35. The apparatus of claim 22, wherein said controller is configured to maintain a constant voltage to said reversible solid state device and modulate a speed of said internal compartment fan.

36. The apparatus of claim 22, wherein said internal compartment fan is selected from the group consisting of discreet speed controlable fans, continuous speed fans, variable speed fans, and combinations thereof.

37. The apparatus of claim 22, further comprising an internal compartment thermistor disposed in said internal compartment so as to contact said internal compartment air;

wherein said internal compartment thermistor is coupled to said controller; air temperature using data acquired from said internal compartment thermistor.

38. The apparatus of claim 22, wherein said at least one temperature operational mode is selected from the group consisting of a cooling mode, a heating mode, and combinations thereof;

wherein said controller is configured to hold said internal compartment air temperature in a range from about 40 degrees F. to about 50 degrees F. when operating in said heating mode.

39. The apparatus of claim 22, wherein said at least one temperature operational mode is selected from the group consisting of a cooling mode, a heating mode, and combinations thereof;

wherein said controller is configured to hold said internal compartment air temperature in a range from about 20 degrees F. to about 30 degrees F. when operating in said cooling mode.

40. The apparatus of claim 22 further comprising a user interface coupled to said controller;

wherein said user interface is configured to allow a user to select at least one operational mode;

wherein said at least one temperature operational mode is selected from the group consisting of a cooling mode, a heating mode, and combinations thereof.

41. The apparatus of claim 22, wherein said apparatus is disposed in temperature controlled device, wherein said temperature controlled device is selected from the group consisting of an internal freezer compartment, a door mounted freezer compartment, an internal refrigerator compartment, a door mounted refrigerated compartment, and combinations thereof.

42. The apparatus of claim 22, further comprising a internal compartment door being disposed to provide a user access to said internal compartment.

43. A method for temperature control comprising:

modifing a compartment air temperature inside a compartment by controlling a reversible solid state device and a compartment fan;

flowing a compartment air across a second section of said reversible solid state device, wherein said second section is disposed within said compartment;

flowing a temperature controlled air across a first section of said reversible solid state device, wherein a portion of said first section is disposed outside said compartment;

controlling said compartment air temperature in at least one temperature operational mode, wherein said temperature operational mode is selected from the group consisting of a cooling mode, a heating mode and combinations thereof.

44. The method of claim 43 further comprises changing an electrical polarity of an electrical power supply to said reversible solid state device to switch from said cooling mode to said heating mode.

45. The method of claim 43 further comprises changing an electrical polarity of an electrical power supply to said reversible solid state device to switch from said heating mode to said cooling mode.

46. The method of claim 43 further comprising holding said compartment air temperature in a range from about 40 degrees F. to about 50 degrees F. when operating in said heating mode.

47. The method of claim 43 further comprising holding said compartment air temperature in a range from about 20 degrees F. to about 30 degrees F. when operating in said cooling mode.

48. A method for temperature control comprising:

modifing an interior compartment air temperature inside an interior compartment by controlling a reversible solid state device and an internal compartment fan;

flowing an interior compartment air across a second section of said reversible solid state device, wherein said second section is disposed within said interior compartment;

flowing an external air across a first section of said reversible solid state device, wherein a said first section is disposed in said exterior compartment;

controlling said interior compartment air temperature in at least one temperature operational mode.

wherein said temperature operational mode is selected from the group consisting of a cooling mode, a heating mode and combinations thereof.

49. The method of claim 48, wherein said at least one temperature operational mode is selected from the group consisting of a heating mode, a cooling mode, and combinations thereof.

wherein said temperature operational mode is selected from the group consisting of a cooling mode, a heating mode and combinations thereof.

50. The method of claim 48 further comprises changing an electrical polarity of an electrical power supply to said reversible solid state device to switch from said cooling mode to said heating mode.

51. The method of claim 48 further comprising changing an electrical polarity of an electrical power supply to said reversible solid state device to switch from said heating mode to said cooling mode.

52. The method of claim 48 further comprising holding said internal compartment air temperature in a range from about 40 degrees F. to about 50 degrees F. when operating in said heating mode.

53. The method of claim 48 further comprising holding said internal compartment air temperature in a range from about 20 degrees F. to about 30 degrees F. when operating in said cooling mode.

* * * * *